United States Patent [19]

Barlow et al.

[11] 4,141,175

[45] Feb. 27, 1979

[54] ACTION TOY

[75] Inventors: Gordon A. Barlow; Palmer J. Schoenfield, both of Evanston, Ill.

[73] Assignee: Marvin Glass & Associates, Chicago, Ill.

[21] Appl. No.: 767,394

[22] Filed: Feb. 14, 1977

[51] Int. Cl.[2] ..... A63H 11/10

[52] U.S. Cl. ..... 46/103; 46/115

[58] Field of Search ..... 46/103, 104, 105, 106, 46/107, 97, 98, 99, 115, 116, 118, 119, 120, 264, 265, 266, 145, 206, 75

[56] References Cited

U.S. PATENT DOCUMENTS

| | | | |
|---|---|---|---|
| 2,881,559 | 4/1959 | Glass | 46/104 |
| 3,103,762 | 9/1963 | Glass et al. | 46/232 |
| 3,161,988 | 12/1964 | Junker | 46/75 |
| 3,369,811 | 2/1968 | Glass et al. | 46/118 X |
| 3,594,947 | 7/1971 | Hartling | 46/116 |
| 3,961,440 | 6/1976 | Saito | 46/206 |

*Primary Examiner*—Russell R. Kinsey
*Assistant Examiner*—Mickey Yu
*Attorney, Agent, or Firm*—Mason, Kolehmainen, Rathburn & Wyss

[57] ABSTRACT

An action toy is provided in the form of a robot having an upstanding body portion, a head portion mounted on top of the body portion, and a base at the bottom of the body portion. The toy has a plurality of wheels on the underside of the base portion rotatably mounted thereon, with two front wheels and a manually steerable rear wheel for pushing the robot over a support surface such as a floor. The robot has limbs from which projectiles may be launched and from which a flexible tethered-type crane mechanism can lift accessory items upwardly from the support surface and into compartments in the body and head of the robot. A manual crank is provided for driving one of the front wheels of the robot and a missile-type projector is provided on the top of the robot for projecting disc-type objects outwardly therefrom.

7 Claims, 7 Drawing Figures

42
40
20
5
5
94
12
E
58
16
6
68
B
74
6
52
18
72
50
10
36
54
48
14
39
46
44

42
40
82
90
20
12
94
38
36
10
50
30
34
32
26
39
14
22
26
22
28
28

14
30
34
24
28
46
44
22
28
26

20
82
86
88
12
62
72
66
64
16
68
70
C
10
18
50
48
36
38
28
26
22
46
44
14
84
90
92
80
D
58
A
60
52
56
54

ACTION TOY

BACKGROUND AND SUMMARY OF THE INVENTION

This invention relates to an action toy which has multiple functions as performed by a robot-type figure.

Robots have always enjoyed fascination with children to simulate actions or performances of an actual human by means of a mechanical structure.

In the present invention, the robot includes an upright body portion on top of which is mounted a head portion, with a base at the bottom of the upright body portion. The base houses wheels rotatably mounted on the bottom thereof for moving the robot over a support surface such as a floor or the like. One of the wheels can be driven by a crank mechanism extending upwardly along the upright body portion. Another of the wheels can be manually rotated to a fixed position for steering the robot over the support surface. Compartments are provided in the head portion, in the body portion, and on top of the base portion for receiving accessory items. The robot has two arms rotatably mounted on the body portion for movement in a vertical plane.

One of the arms of the robot has a missile projector which is spring loaded and manually operated so as to be capable of projecting missiles from the terminal end of the arm.

The other arm has a flexible tethering line having a grasping hook at the end thereof for picking up accessory objects off of the support surface and the child can move the accessory items into the compartments defined above. A launcher is provided on the top of the head portion of the robot for projecting disc-like objects therefrom by means of a spring loaded wire projector.

A principal object, therefor, of the present invention is to provide an action toy in the form of a robot as described and characterized above.

Other objects, features and advantages of the invention will be apparent from the following detailed description taken in connection with the accompanying drawings.

DETAILED DESCRIPTION OF THE INVENTION

Figure 1:
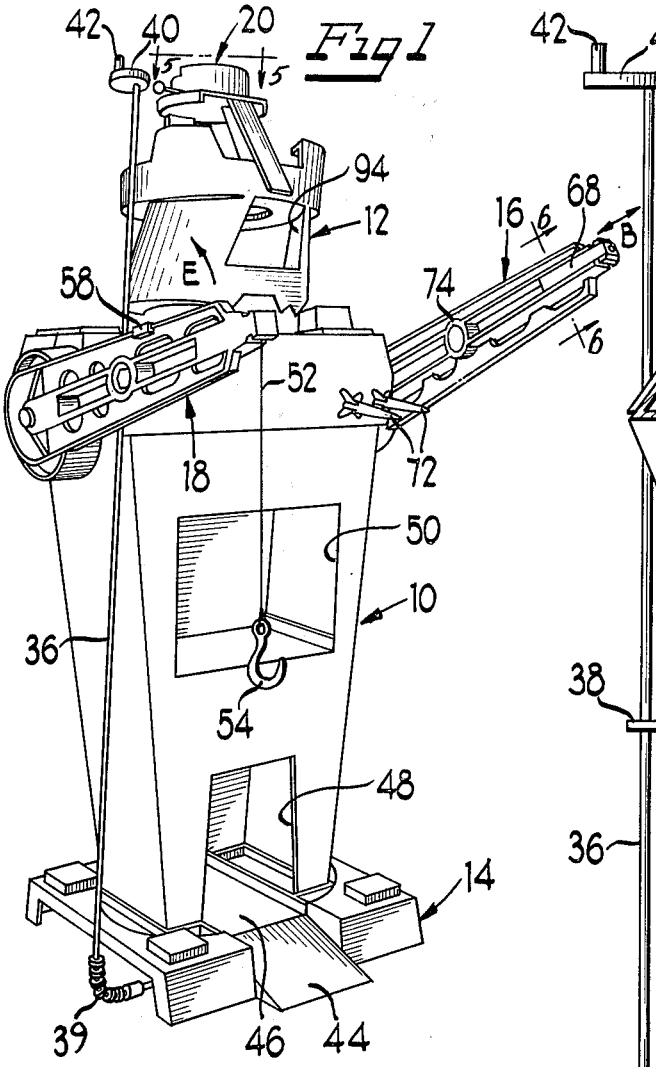
FIG. 1 is a perspective view of an action toy in the form of a mechanical robot in accordance with the present invention.

Referring to the drawings in greater detail, FIGS. 1–4 show an action toy in the form of a mechanical robot having a body portion, generally designated 10, on top of which is mounted a head portion, generally designated 12, with a base portion, generally designated 14, at the bottom of the body portion. A lefthand arm, generally designated 16, is provided with a projectile launcher to be described hereinafter. A righthand arm, generally designated 18, is provided with a crane-type mechanism which will be described hereinafter. The head portion 12 has a launching mechanism, generally designated 20, for projecting disc-like objects outwardly therefrom.

Figure 2:
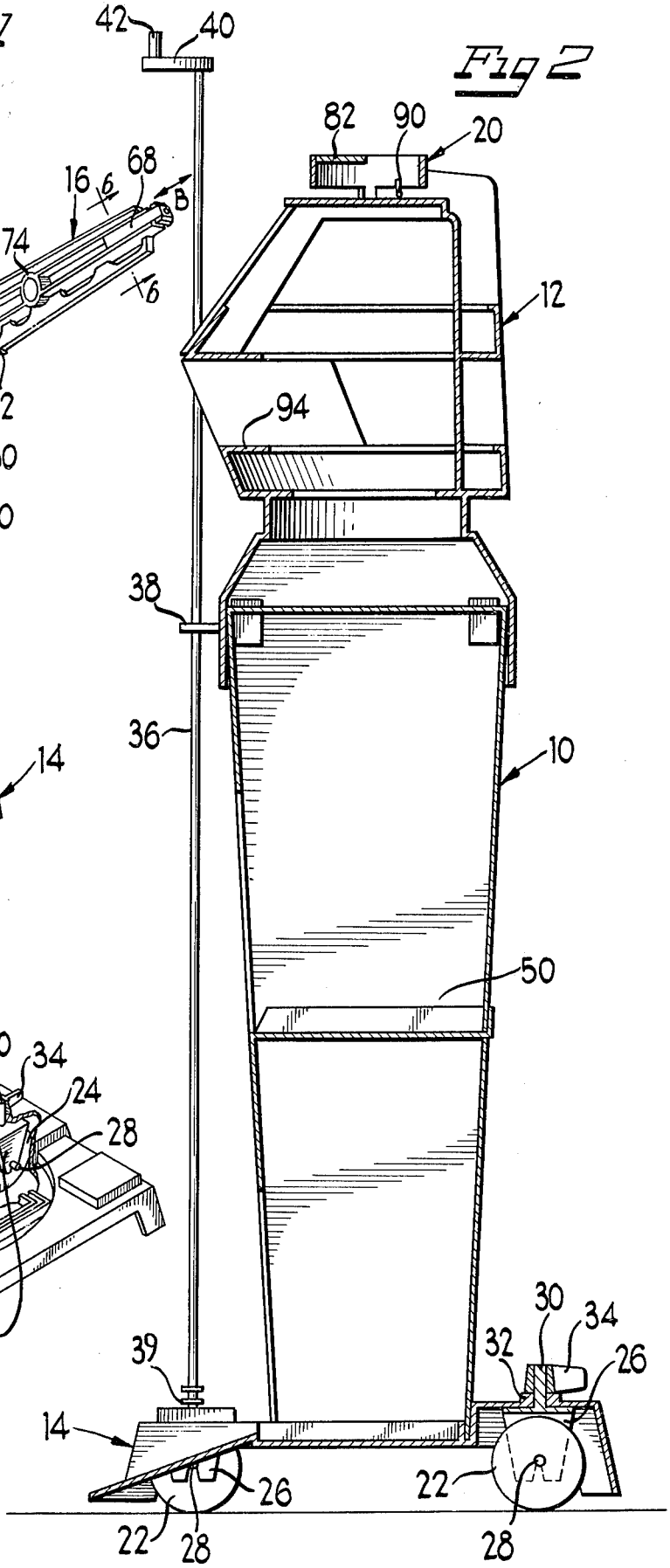
FIG. 2 is a vertical central section, on an enlarged scale, of the robot of FIG. 1.
Figure 3:
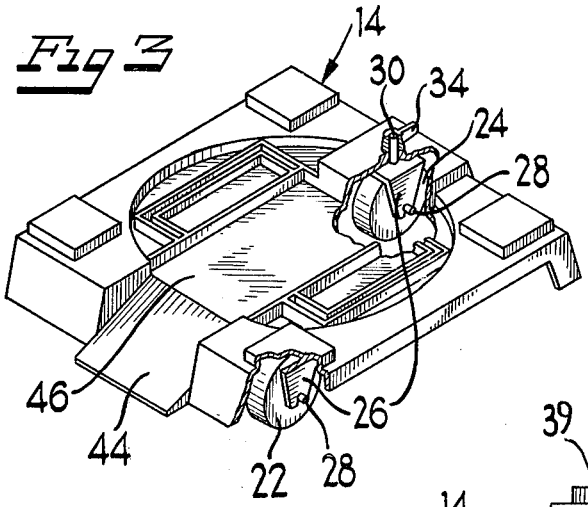
FIG. 3 is a perspective view of the base portion of the robot shown in FIG. 1 with the body portion removed therefrom.

More particularly, the base 14 is provided with two front wheels 22 and a single rear wheel 24 rotatably mounted on the underside thereof by brackets 26 and pins 28 (see FIG. 3). The front wheels 22 are freely rotatable but fixed in a front to rear forward plane. However, as seen in FIGS. 2 and 3, the rear wheel 24 has an upwardly extending shaft 30 on top of its bracket 26, with the shaft extending through a boss 32 formed on top of the base 14. A manually graspable handle 34 is fixed to the shaft 30 so as to be capable of rotating the wheel 24, through its bracket 26, so that a child may steer the robot over a supporting surface, such as a floor, or the like.

Figures 4, 5, 6, 7:
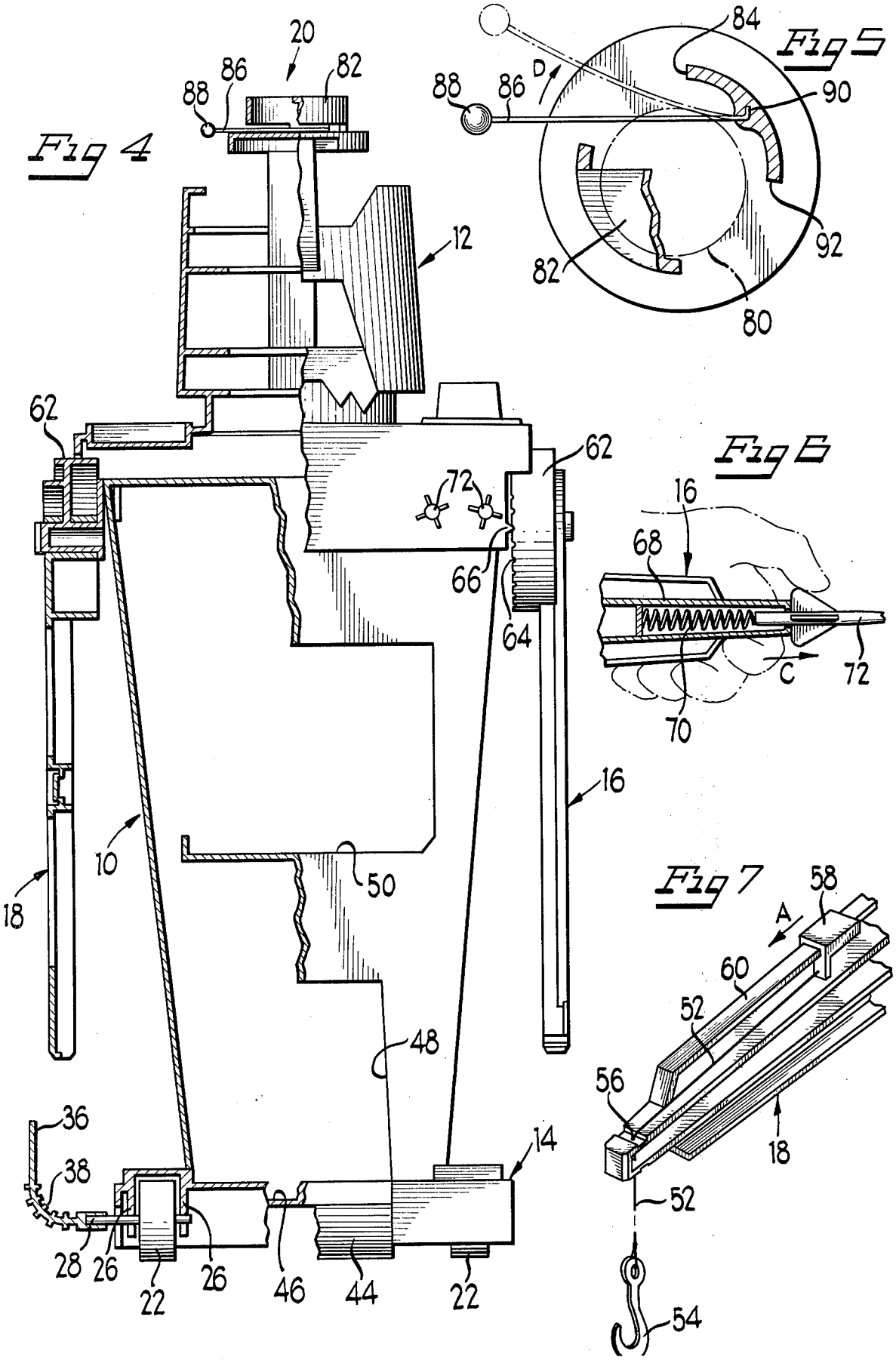
FIG. 4 is a fragmented side-to-side vertical section, on an enlarged scale, of the robot of FIG. 1.
FIG. 5 is a fragmented horizontal section, on an enlarged scale, taken generally along line 5—5 of FIG. 1.
FIG. 6 is a fragmented vertical section taken generally along the line 6—6 in FIG. 1.
FIG. 7 is a perspective view, on an enlarged scale, of the crane-type mechanism disposed at the end of the right-hand arm of the robot shown in FIG. 1.

Referring to FIGS. 1 and 2, an upwardly extending shaft 36 extends through a bracket 38 (see FIG. 2) on the side of the body portion 10 for providing a driving connection to the righthand front wheel 22 (see FIG. 4). The shaft 36 is connected to the pin 28 of the righthand wheel by a flexible joint 39 at the bottom of the shaft 36 but is fixedly connected to the pin of the wheel for rotating the same. The top of the shaft 36 is provided with a hand crank 40 having an upwardly extending handle portion 42 so that rotation of the crank and thus the shaft 36 will rotate the righthand wheel 22, through the flexible connection 39, to drive the robot in a circular manner depending upon the set position of the rear wheel 24.

The base 14 also has a ramp 44 at the front end thereof leading towards a platform 46 (see FIGS. 1 and 3) over which accessory vehicles (not shown) can be moved for placing within a compartment provided by an aperture 48 at the bottom front of the body portion 10.

The body portion 10 also is provided with a central frontwardly opening compartment 50 (see FIG. 1) into which accessory items can be moved and stored.

To this end, the righthand arm 18 of the robot is provided with a crane-like mechanism seen best in FIGS. 1 and 7. The crane mechanism includes a flexible tethering line 52 which has a grasping or hook portion 54 at a freely downwardly extending end of the line as it extends upwardly through the front terminal end of the arm 18, as at 56 in FIG. 7. The line 52 is connected at its opposite end to a friction slide 58 which is slidable along a flange 60 on top of the arm 18. In this manner, the hook 54 can be lowered by moving the slide 58 in the direction of arrow A (FIG. 7) and lifted by moving the slide in the opposite direction. As a child lifts the hook 54 upwardly in relation to the support surface on which the robot is placed, the hook can be stopped at the elevated position of the compartment 50 and any accessory item grasped by the hook can be moved laterally over into the compartment.

In addition, each of the arms 16 and 18 (see FIG. 4) has an annular shoulder portion 62 which has detent notches 64 engageable with a detent 66 formed on the side of the body portion 10 in the area of the arm shoulder 62. Each of the arms is so constructed so that the arms (in addition to the hook 54) can be raised to predetermined positions.

The lefthand arm 16 is provided with a launching mechanism which is shown in FIGS. 1 and 6. The launching mechanism includes a receptacle 68 mounted for longitudinal movement within the end of the lefthand arm 16. The receptacle 68 is slidably mounted within the arm for reciprocal movement in the direction of double-ended arrow B (FIG. 1). The receptacle is spring loaded by a coil spring 70 (FIG. 6) so that as the receptacle is retracted longitudinally within the arm 16 and released, the coil spring 70 will snap the receptacle outwardly in the direction of arrow C (FIG. 6). A plurality of missile-type launchers 72 are provided for positioning within the receptacles 68 for launching thereby. As seen in FIG. 1, the missile 72 can be positioned within apertures (not shown) in the body portion for storage purposes. In addition, a handle or knob 74 (FIG. 1) can be provided for pulling the receptacle 68 toward the body portion of the robot and for release purposes to launch the missiles 72.

The action toy or robot of the present invention also is provided with the launcher 20 on top of the head portion 12 so as to project disc-like objects 80 (FIG. 5) outwardly from the head portion. To this end, a cylindrical vertically extending receptacle 82 (FIG. 4) is provided for receiving a stack of disc-like objects 80. A notch 84 (FIG. 5) is provided in the side of the receptacle 82. A spring wire 86 having a ball handle 88 on the end thereof is fixed, as at 90, to the base of the receptacle 82 for cocking in the direction of arrow D (FIG. 5) to the phantom position shown within the slot 84. Release of the spring rod 86 will strike the bottommost disc within the receptacle 82 and propel the disc outwardly through an additional slot 92 (FIG. 5) outwardly away from the top of the robot head portion 12.

The head portion 12 of the robot also has a compartment 94 which opens at the front thereof within which accessory items may be placed or moved thereinto by rotating the righthand arm 18 upwardly in the direction of arrow E (FIG. 1) so as to align the hook 54 with the compartment 94 and laterally swinging the hook so as to place the accessory item within the compartment 94 of the head portion 12.

The foregoing detailed description has been given for clearness of understanding only and no unnecessary limitations should be understood therefrom as some modifications will be obvious to those skilled in the art.

We claim:

1. An action toy in the form of a robot, comprising:
a body portion;
a head portion mounted on top of said body portion;
a base at the bottom of said body portion;
drive means on the base portion for moving the toy robot over a support surface;
a pair of limbs mounted on the body portion and protruding outwardly therefrom;
an outwardly opening compartment in said body portion;
a crane-type mechanism mounted on one of said limbs for grasping and lifting accessory items for manually moving the items into said compartment; and
a projector on the other of said limbs for manually launching accessory items therefrom.

2. The action toy of claim 1 wherein said crane mechanism includes a flexible tethering line mounted at one end thereof to said limb and having a grasping mechanism at the other end thereof for manually moving an accessory item into said compartment.

3. The action toy of claim 2 wherein said limb is mounted on said body portion by means providing movement in relation thereto.

4. An action toy in the form of a robot, comprising:
a body portion;
a head portion mounted on the top of said body portion;
a limb mounted to said body portion;
a base at the bottom of said body portion;
drive means on said base for moving the toy robot over a supporting surface;
means for steering said drive means to guide the toy robot over the support surface; and
a crane mechanism for picking up accessory items, said crane mechanism including a tethering line connected at one end to a slide mechanism on said limb and on the other end to a grasping mechanism whereby the tethering line can be moved generally vertically by manually moving said slide mechanism.

5. An action toy in the form of a robot, comprising:
a body portion;
a head portion mounted on top of said body portion;
a base at the bottom of said body portion;
drive means on said base for moving the toy robot over a support surface;
a pair of limbs mounted to said body portion for movement between a raised position and a lower position and means on each limb for performing different functions;
an outwardly opening compartment in said body portion for storing accessory items;
means for steering said drive means to guide the toy robot over the support surface; and
means for projecting disc-like objects outwardly from said toy and receptacle means for receiving and vertically stacking said disc-like objects.

6. An action toy in the form of a robot, comprising:
a body portion;
a head portion mounted on top of said body portion;
a base at the bottom of said body portion;
drive means on said base for moving the toy robot over a support surface;
a pair of limbs mounted to said body portion for movement between a raised position and a lower position and means on each limb for performing different functions;
an outwardly opening compartment in said body portion for storing accessory items;
means for steering said drive means to guide the toy robot over the support surface; and
a receptacle means for receiving and vertically stacking disc-like objects and means for projecting the bottom-most disc-like object outwardly from said toy.

7. An action toy in the form of a robot, comprising:
a body portion;
a head portion mounted on top of said body portion;
a base at the bottom of said body portion;
drive means on said base for moving the toy robot over a support surface;
a pair of limbs mounted to said body portion for movement between a raised position and a lower position and means on each limb for performing different functions;

an outwardly opening compartment in said body portion for storing accessory items;

means for steering said drive means to guide the toy robot over the support surface; and a receptacle means for receiving and vertically stacking disc-like objects and means for projecting the bottom-most disc-like object outwardly from said toy wherein said projecting means includes a spring wire which can be moved to a cocking position and released so as to strike the bottommost disc-like object of the stack thereof and project the disc outwardly away from the toy.

* * * * *